US005979783A

United States Patent [19]

Toht et al.

[11] Patent Number: 5,979,783

[45] Date of Patent: Nov. 9, 1999

[54] TOY VEHICLE TRACK COUPLING SUPPORT

[75] Inventors: Donald E. Toht, Wheaton; Yvan Tinel, Riverside, both of Ill.

[73] Assignee: Learning Curve International, Inc., Chicago, Ill.

[21] Appl. No.: 08/953,944

[22] Filed: Oct. 20, 1997

[51] Int. Cl.[6] ..... E01B 23/00

[52] U.S. Cl. ..... 238/10 E; 104/DIG. 1; 104/126; 446/476

[58] Field of Search ..... 446/447, 476, 446/478; 238/10 A, 10 E, 10 F, 10 R; 104/53, DIG. 1, 125, 126; 105/1.5

[56] References Cited

U.S. PATENT DOCUMENTS 5,687,649 11/1997 Koeninger et al. ..... 104/126

5,890,948 4/1999 Nilsson ..... 446/476

OTHER PUBLICATIONS

Learning Curve Toys 1997 Wholesale Catalog, pp. 27–28.

Brio Promotional Catalog, p. 26.

Eichorn Promotional Catalog.

*Primary Examiner*—Robert J. Oberleitner
*Assistant Examiner*—Robert J. McCarry, Jr.
*Attorney, Agent, or Firm*—Wallenstein & Wagner, Ltd.

[57] ABSTRACT

A device for supporting a coupling between at least two toy vehicle track sections. The device includes a retractable connector support and a support housing. The retractable connector support is an extensible body produced from a rigid material. The retractable connector support can be positioned so that it engages the coupling. The support housing is adapted for receiving the retractable connector support and is placed adjacent the coupling.

20 Claims, 2 Drawing Sheets

TOY VEHICLE TRACK COUPLING SUPPORT

TECHNICAL FIELD

The present invention relates generally to toy vehicle tracks, but more particularly, the present invention relates to a device for supporting a coupling used to join two sections of toy vehicle tracks.

BACKGROUND

In the toy vehicle industry, small toy trains are often run on wooden tracks. These railway systems are designed to grow with the child. In other words, railway configurations can range from very simple ovals to complex systems incorporating bridges, buildings, tunnels, and towns. Many other accessories are available as well such as: toy figurines, bushes, shrubs, and trees to lend the system a realistic effect; playmats, playboards, and play tables on which to build a railway system; carry bags and boxes in which to store the railway system when not in use; and, storybooks, iron-ons, decals, and coloring books to further stimulate the child's imagination.

The railway configurations are built from individual track sections. The track sections range in size and shape. There are countless possibilities for individual track sections: some are straight; some feature switching mechanisms; some are curved; some are ascending for connection to another track positioned at a higher level; and, some comprise bridge segments, buildings, or tunnels.

One of the most important aspects of these railway systems is that the track sections be interchangeable. Accordingly, each track section typically has a male connector at one end and a female connector at an opposing end. This allows the track sections to be connected end to end in variety of configurations. Adding to the interchangeability of the track sections is the fact that these track sections are usually reversible having rails impregnated on the top and bottom.

As these toy railway systems are designed for children beginning at preschool age, safety is an issue. Designers endeavor to create aesthetically pleasing toy railway systems while at the same time eliminating safety hazards for young children. Therefore, designs that include small removable parts that could be swallowed are avoided.

One of the problems facing designers today is the connection of incoming, ascending segments to other track sections, such as bridge segments, which are positioned at a different height than the incoming, ascending segment. In the case of a bridge segment, as the ascending segments are connected to the bridge, the coupling, consisting of the male portion of one piece frictionally engaging the female portion of the other piece, is often suspended off the bridge segment in midair. This coupling must be supported to insure its integrity. Therefore, a method for supporting the coupling must be devised which allows for maximum interchangeability and is safe for preschool children.

Prior art support systems fail to provide this interchangeability and safety. For example, one design features a bridge segment having female connector portions on either end. The female connector portions are located within the profile of the bridge with the bridge providing the support for the male-female connection. Such a design is illustrated in learning Curve Toys' 1997 Wholesale Catalog. This design does not offer the interchangeability sought because at some point in the railway system, two male connectors will meet each other necessitating the addition of an adapter section having two female connectors.

Another design comprises a bridge segment having a removable connector support. The removable support is force fit between two restraining pegs located on the underside of the bridge. The removable support extends beyond the profile of the bridge below the coupling to provide support to the coupling. This design is not desirable because the removable support can be lost or become worn and, subsequently, provide little if any, support.

Thus, there exists a need for a connection support which is safe, provides the requisite interchangeability, and remains reliable over many uses.

SUMMARY OF THE INVENTION

The present invention is directed to a toy vehicle track coupling support for reinforcing the coupling between at least two lengths of toy vehicle track sections. The toy vehicle track coupling support comprises a retractable connector support and a support housing.

The retractable connector support is designed so that it is extensible. That is, it may be alternately positioned under the coupling provided by the male and female portions of the respective track sections or stored beneath one of the track sections when not in use.

The support housing is generally located beneath one of the track sections. This support housing is provided for storing the retractable connector when it is not in use. The support housing also aligns the retractable connector support properly so it engages the coupling to provide reliability to the coupling.

Other advantages and aspects of the present invention will become apparent upon reading the following description of the drawings and detailed description of the invention.

DETAILED DESCRIPTION

Figure 1:
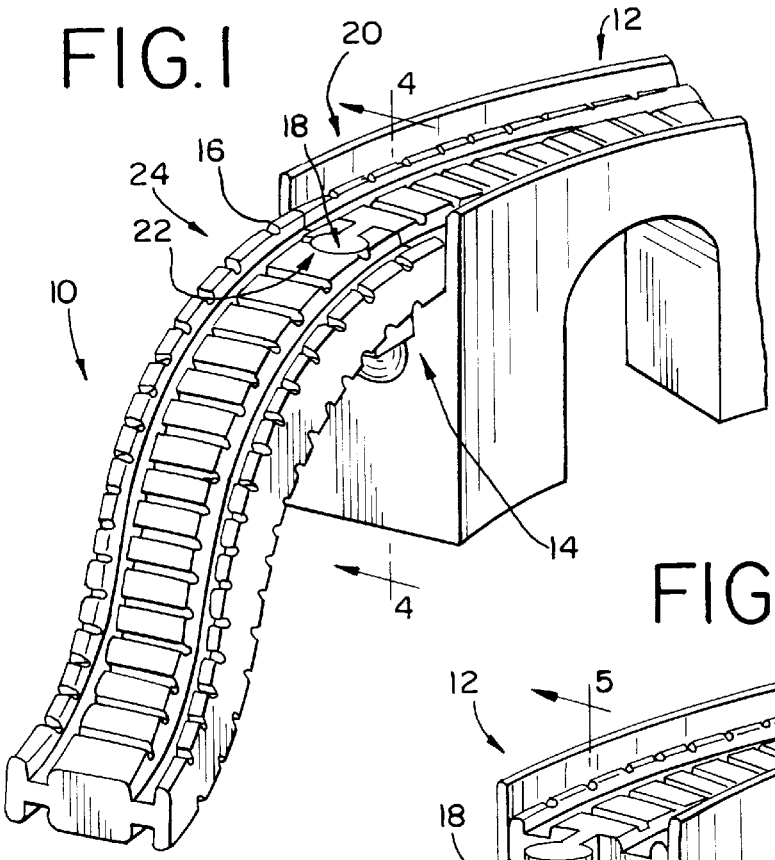
FIG. 1 is a perspective view of an ascending toy vehicle track section connected to a track section comprising a toy vehicle track coupling support.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

Referring to FIG. 1, two toy vehicle track sections are illustrated. An ascending segment 10 is joined to a bridge segment 12 comprising a toy vehicle track coupling support 14 of the present invention. The toy vehicle track coupling support 14 of the present invention braces a coupling 16 between at least two sections of toy vehicle track. These toy vehicle track sections have a male fitting 18 at a distal end 20 and a female fitting 22 at a proximal end 24. The track sections are joined as the male fitting 18 at the distal end 20 of a first track section is joined with the female fitting 22 at the proximal end 24 of a second track section. In certain instances, these toy vehicle track sections will comprise either ascending or descending segments. Often, when ascending or descending segments are included in the track layout, the coupling 16 will be suspended in midair and, thus, requires a support to maintain its integrity. Accordingly, the toy vehicle track coupling support 14 of the present invention braces the coupling 16 to maintain the integrity of the coupling 16.

Figure 2:
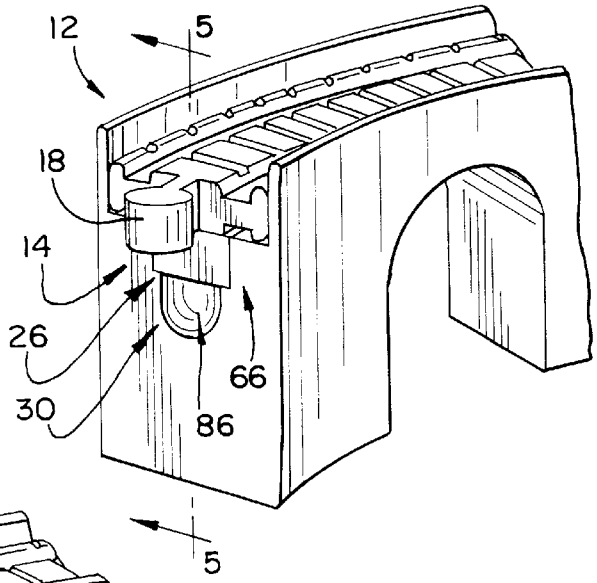
FIG. 2 is a perspective view of a non-extended retractable connector support.
Figure 3:
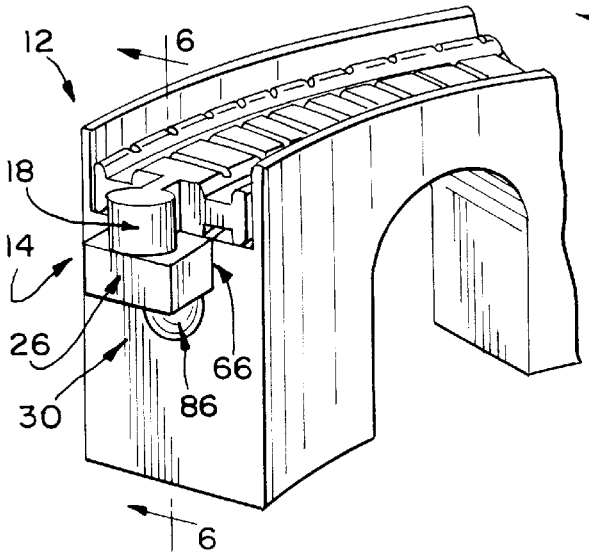
FIG. 3 is a perspective view of an extended retractable connector support.

Referring to FIGS. 2 and 3, the toy vehicle track coupling support 14 comprises a retractable connector support 26 and a support housing 30. The retractable connector support 26 is generally a small body produced from a rigid material, such as wood or plastic, that is extensible from some portion of the support housing 30.

The retractable nature of the connector support 26 produces a degree of flexibility in constructing railway configurations. For instance, if the bridge segment 12 is connected to an identical bridge segment 12, there is no need for the retractable connector support 26, and it can be stored in the support housing 30. If the connector support 26 was not retractable, connecting bridge segments 12 in tandem would be impossible because the connector support 12 would preclude the two bridge segments 12 from abutting one another.

Figure 4:
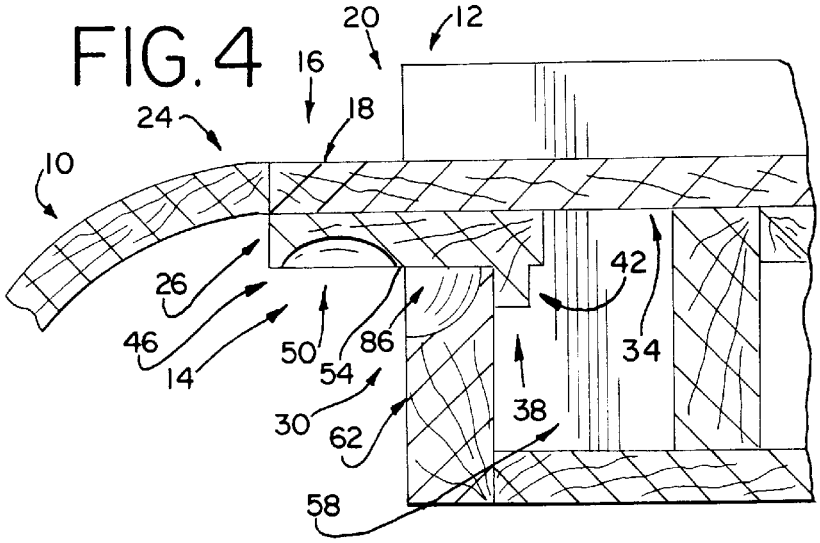
FIG. 4 is a sectional view taken along 4—4 of FIG. 1.

Now, referring to FIG. 4, the embodiment illustrated has the retractable connector support 26 positioned adjacent an under side 34 of the bridge segment 12. In this embodiment, the retractable connector support 26 is shown positioned beneath the male fitting 18. Although not shown in the figures, the retractable connector support 26 can be positioned beneath the female fitting 22 with equal success.

As shown in FIG. 4, the retractable connector support 26 further comprises a means for retaining a portion of the retractable connector support within the support housing 38. The means for retaining a portion of the retractable connector support within the support housing 38 generally comprises a depending structure 42 that protrudes from the retractable connector support 26. This depending structure 42 can be an arm or other component such as a dowel rod or a ledge. The depending structure 42 engages a portion of the support housing 30 as the retractable connector support 26 is extended from the support housing 30. The purpose of the means for retaining a portion of the retractable connector support within the support housing 38 is to prevent the retractable connector support 26 from becoming separated from the support housing 30 and subsequently becoming lost or a safety hazard.

In an alternative embodiment, not shown in the drawings, the means for retaining a portion of the retractable connector support within the support housing 38 comprises at least one slot formed in the retractable connector support 26 and an engaging segment located on the support housing 30. In this embodiment, the engaging segment is seated within the slot. As the retractable connector support 26 is extended from the support housing 30, the engaging segment slides within the slot until an abutment prevents the engaging segment from sliding any farther.

In yet another embodiment, also not shown in the drawings, the means for retaining a portion of the retractable connector support within the support housing 38 comprises a tapered retractable connector support 26. As the tapered retractable connector support 26 is withdrawn from the support housing 30. The wider portion of the tapered retractable connector support 26 engages a portion of the support housing 30 to retain the wider portion of the retractable connector support 26 within the support housing 30.

The retractable connector support 26 can further include a handle 46 for withdrawing the retractable connector support 26 from the support housing 30. In the embodiment illustrated, the handle 46 comprises a finger grip 50 located on a first side 54 of the retractable connector support 26. The finger grip 50 is bored into the retractable connector support 26 and is sized using anthropomorphic data so that the tip of a human finger fits within the finger grip 50. The finger grip 50 functions as a person inserts his/her finger into the finger grip 50 and pulls the retractable connector from the support housing 30 until the means for retaining the connector support within the support housing 30 prevents the retractable connector support 26 from extending any farther from the support housing 30.

The support housing 30 is adapted for receiving the retractable connector support 26. Accordingly, the support housing 30 is positioned below the toy vehicle track section. The support housing 30 can be a simple frame to support the retractable connector support 26 or an enclosure. Accordingly, the support housing 30 has an interior 58 and an exterior 62. The interior 58 of the support housing 30 is designed to accommodate the retractable connector support 26 and allow the retractable support to be easily withdrawn from the support housing 30. In the preferred embodiment, the interior 58 comprises an opening 66 for receiving the retractable connector support 26, a support wall 70, a retaining wall 74, and a limiting wall 78. (See FIG. 5).

The opening 66 is positioned below the distal end 20 and/or proximal end 24 of the track section. In cross-section, the opening 66 has a profile that is approximately equal to the size and shape of the cross-section of the retractable connector support 26. (See FIGS. 2 and 3).

Figure 5:
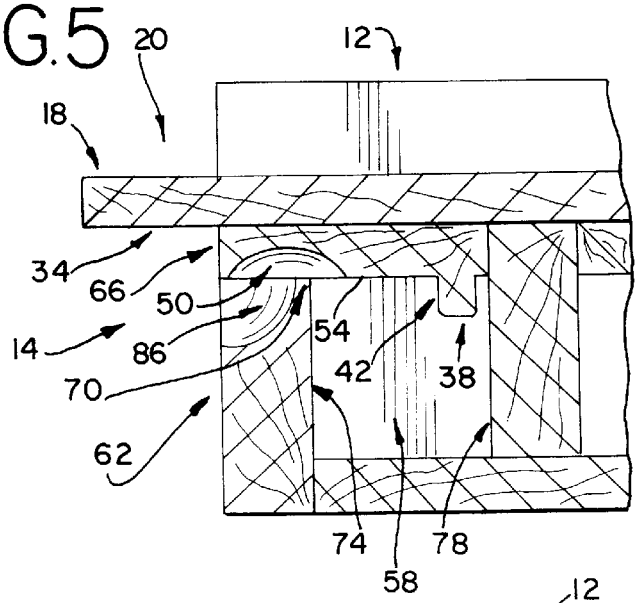
FIG. 5 is a sectional view taken along 5—5 of FIG. 2.
Figure 6:
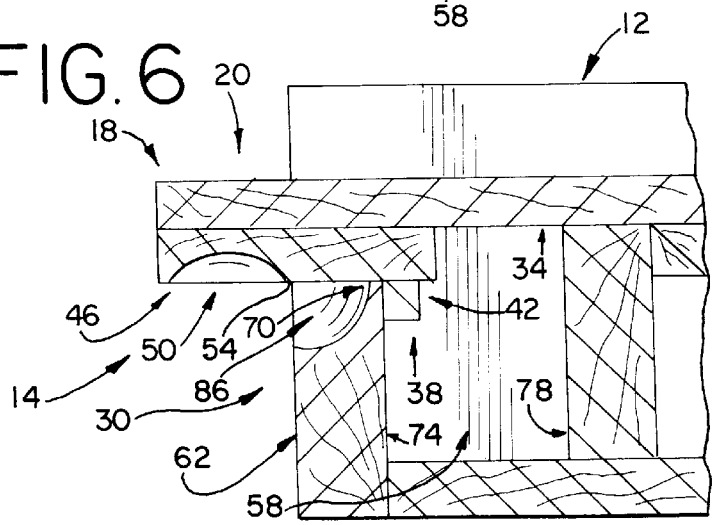
FIG. 6 is a sectional view taken along 6—6 of FIG. 3.

Referring to FIGS. 5 and 6, the support wall 70 is positioned below the retractable connector support 26. The first side 54 of the retractable connector support 26 engages the support wall 70. This structure acts to support the retractable connector support 26 within the support housing 30.

The retaining wall 74 is positioned adjacent the opening 66. The retaining wall 74 cooperates with the means for retaining a portion of the retractable connector support within the support housing 38 to prevent the retractable connector support 26 from being completely withdrawn from the support housing 30. As the retractable connector support 26 is extended from the support housing 30, the means for retaining a portion of the retractable connector support within the support housing 38 engages the retaining wall 74. Thus, a portion of the retractable connector support 26 is maintained within the support housing 30.

The limiting wall 78 opposes the retaining wall 74. The limiting wall 78 restricts the extent to which the retractable connector support 26 can be inserted into the support housing 30. As the retractable connector support 26 is inserted into the support housing 30, it contacts the limiting wall 78, and the retractable connector support 26 cannot be advanced any farther into the support housing 30. Thus, the retractable connector support 26 is prevented from becoming lost within the support housing 30.

The exterior 62 of the support housing 30 can be a simple frame to support the retractable connector support 26. In the preferred embodiment, the exterior 62 of the support housing 30 is defined by the toy vehicle track section. In FIG. 2 through 6, the support housing 30 is positioned under the rail portion of the bridge segment 12. The supporting bridge structure defines the exterior 62 of the support housing 30.

In the preferred embodiment, the exterior 62 of the support housing 30 further includes a finger groove 86. The finger groove 86 is an arcuate portion bored into the support housing 30. This finger groove 86 is aligned with the finger grip 50 of the retractable connector support 26. The finger groove 86 enables the user to easily access the finger grip 50 and withdraw the retractable connector support 26 from the support housing 30.

While specific embodiments have been illustrated and described, numerous modifications are possible without departing from the spirit of the invention, and the scope of protection is only limited by the scope of the accompanying claims.

We claim:

1. For a first toy vehicle track section coupled to a second toy vehicle track section by means of a coupling, a device for supporting the coupling, comprising:

a support housing for placement adjacent the coupling, the support housing including a retractable connector support, the retractable connector support being extensible from the support housing to supportingly engage the coupling.

2. The device of claim 1 wherein the support housing is connected to one of the toy vehicle track sections.

3. The device of claim 2 further including a means for retaining a portion of the retractable connector support within the support housing.

4. The device of claim 3 wherein the means for retaining a portion of the retractable connector support within the support housing comprises a depending structure, the depending structure being fixedly connected to the retractable connector support wherein the depending structure is adapted to engage a portion of the support housing to prevent the portion of the retractable connector support from being removed from the support housing.

5. The device of claim 1 wherein the retractable support has a handle for sliding the retractable connector support from the support housing.

6. The device of claim 5 wherein the handle comprises a finger grip, the finger grip being defined by the retractable connector support.

7. The device of claim 1 wherein the retractable connector support is produced from a rigid material.

8. In a toy vehicle bridge segment, a device for supporting a coupling between a first toy vehicle track segment and a second toy vehicle track segment, comprising:

a support housing for placement adjacent the coupling, the support housing including a retractable connector support, the retractable connector support being extensible from the support housing to supportingly engage the coupling.

9. The device of claim 8 wherein the support housing is located within the bridge segment.

10. The device of claim 8 further including a means for retaining a portion of the retractable connector support within the support housing.

11. The device of claim 10 wherein the means for retaining a portion of the retractable connector support within the support housing comprises a depending structure, the depending structure being fixedly connected to the retractable connector support wherein the depending structure is adapted to engage a portion of the support housing to prevent the portion of the retractable connector support from being removed from the support housing.

12. The device of claim 8 wherein the retractable support has a handle for sliding the retractable connector support from the support housing.

13. The device of claim 12 wherein the handle comprises a finger grip, the finger grip being defined by the retractable connector support.

14. The device of claim 13 wherein the bridge segment comprises a finger groove, the finger groove being in alignment with the finger grip.

15. The device of claim 8 wherein the retractable connector support is produced from a rigid material.

16. A device for supporting a coupling between at least two toy vehicle track sections, comprising:

a support housing for placement adjacent the coupling, the support housing including a retractable connector support, the retractable connector support being extensible from the support housing to supportingly engage the coupling; and, a means for retaining a portion of the retractable connector support within the support housing.

17. The device of claim 16 wherein the means for retaining a portion of the retractable connector support within the housing is a depending structure, the depending structure being fixedly connected to the retractable connector support wherein the depending structure is adapted to engage a portion of the support housing to prevent the portion of the retractable connector support from being removed from the support housing.

18. The device of claim 16 wherein the means for retaining a portion of the retractable connector support within the housing is a ledge portion, the ledge portion being fixedly connected to the retractable connector support wherein the ledge portion is adapted to engage a portion of the support housing to prevent the portion of the retractable connector support from being removed from the support housing.

19. The device of claim 16 wherein the retractable connector support comprises a finger grip, the finger grip being defined by the retractable connector support.

20. The device of claim 19 wherein the support housing comprises a finger groove, the finger groove being in alignment with the finger grip.

* * * * *